US009441923B2

(12) United States Patent
Chadwick

(10) Patent No.: US 9,441,923 B2
(45) Date of Patent: Sep. 13, 2016

(54) SHOOTING TARGET MANAGEMENT SYSTEMS AND RELATED METHODS

(71) Applicant: Neil Chadwick, Salisbury, NH (US)

(72) Inventor: Neil Chadwick, Salisbury, NH (US)

( * ) Notice: Subject to any disclaimer, the term of this patent is extended or adjusted under 35 U.S.C. 154(b) by 248 days.

(21) Appl. No.: 14/503,923

(22) Filed: Oct. 1, 2014

(65) Prior Publication Data

US 2015/0091252 A1 Apr. 2, 2015

Related U.S. Application Data

(60) Provisional application No. 61/885,791, filed on Oct. 2, 2013.

(51) Int. Cl.
*F41J 11/00* (2009.01)
*F41J 9/16* (2006.01)

(52) U.S. Cl.
CPC .. *F41J 11/00* (2013.01); *F41J 9/16* (2013.01)

(58) Field of Classification Search
CPC ..... F41J 11/00
See application file for complete search history.

(56) References Cited

U.S. PATENT DOCUMENTS 5,427,380 A * 6/1995 Hazard ..... F41J 9/18 124/32
2007/0082322 A1* 4/2007 Lvovskiy ..... F41A 33/02 434/19
2007/0190495 A1* 8/2007 Kendir ..... F41A 33/02 434/21
2009/0259566 A1* 10/2009 White, III ..... A63B 24/0062 705/26.1
2010/0102512 A1* 4/2010 Dar ..... F41J 9/18 273/362
2011/0183299 A1* 7/2011 Dribben ..... F41G 3/26 434/19
2015/0285593 A1* 10/2015 Dribben ..... F41J 5/10 434/19
2015/0363591 A1* 12/2015 Chen ..... G06F 21/445 726/17
2016/0195370 A1* 7/2016 Adar ..... F41J 5/14 434/16
2016/0209173 A1* 7/2016 Dribben ..... F41G 3/26

* cited by examiner

*Primary Examiner* — Corbett B Coburn
(74) *Attorney, Agent, or Firm* — Hayes Soloway PC

(57) ABSTRACT

A shooting target management system and related methods are provided. The system includes at least one target dispensing device having a plurality of targets. A user control unit is in communication with the at least one target dispensing device and is positioned remotely therefrom. At least one switch is in communication with the user control unit, wherein at least one of the plurality of targets is dispensed from the at least one target dispensing device upon activation of the switch. A user identification (ID) device has a wireless communication system thereon for wireless communication with at least the user control unit. The user ID device stores a quantity of user ID information and a quantity of user target information, wherein at least a portion of the quantity of user target information is updated based on activation of the switch by the user.

20 Claims, 8 Drawing Sheets

SHOOTING TARGET MANAGEMENT SYSTEMS AND RELATED METHODS

CROSS REFERENCE TO RELATED APPLICATION

This application claims benefit of U.S. Provisional Application Ser. No. 61/885,791 entitled, "Shooting Target Management Systems and Related Methods" filed Oct. 2, 2013, the entire disclosure of which is incorporated herein by reference.

FIELD OF THE DISCLOSURE

The present disclosure is generally related to shooting target dispensing systems and more particularly is related to shooting target management systems and related methods.

BACKGROUND OF THE DISCLOSURE

Clay target or clay pigeon shooting with firearms is a popular hobby around the world. There are many commercially available target launching or throwing apparatuses that are used on a regular basis at shooting ranges and other venues where clay target shooting takes place. The target launching apparatuses may include manual or automatic loading and throwing devices, which are designed to throw a plurality of targets from a single position with adjustable vertical and horizontal angles of throw (flight).

Manual target launching devices are often less preferred than automatic devices, due to the fact that a person must be positioned near the manual device to load the clay targets and release the clay target. Automatic launching devices often use electronic controllers, whereby a shooter can activate the device remotely. Controlling the quantity of targets launched can be complicated, and often involves physical keys that are physically manipulated with punch-outs or notches according to the quantity of targets launched. While these devices have some success, they suffer from complications and an inability to be flexible to a specific shooter's desires. For example, they are limited in their abilities to manage the number of targets a user can use during a shooting session, as they are limited to counting the number of targets used. They do not allow for variations on shooting arrangements, nor do they allow for heightened management of the number of targets that a specific user can have.

Thus, a heretofore unaddressed need exists in the industry to address the aforementioned deficiencies and inadequacies.

SUMMARY OF THE DISCLOSURE

Embodiments of the present disclosure provide a shooting target management system. Briefly described, in architecture, one embodiment of the system, among others, can be implemented as follows: At least one target dispensing device has a plurality of targets. A user control unit is in communication with the at least one target dispensing device and positioned remotely therefrom. At least one switch is in communication with the user control unit, wherein at least one of the plurality of targets is dispensed from the at least one target dispensing device upon activation of the switch. A user identification (ID) device is communicable with at least the user control unit. The user ID device stores a quantity of user ID information and a quantity of user target information, wherein at least a portion of the quantity of user target information is updated based on activation of the switch by the user.

The present disclosure can also be viewed as providing methods of managing shooting target usage. In this regard, one embodiment of such a method, among others, can be broadly summarized by the following steps: pairing at least one user identification (ID) device to at least one user, wherein the at least one user ID device is communicable with at least the user control unit, wherein the user ID device stores a quantity of user ID information and a quantity of user target information; establishing a communication channel between the at least one user ID device and a user control unit, wherein the user control unit is in communication with the at least one target dispensing device and positioned remotely therefrom; activating at least one switch in communication with the user control unit, thereby dispensing at least one of a plurality of targets from the at least one target dispensing device; and updating at least a portion of the quantity of user target information based on activation of the at least one switch.

Other systems, methods, features, and advantages of the present disclosure will be or become apparent to one with skill in the art upon examination of the following drawings and detailed description. It is intended that all such additional systems, methods, features, and advantages be included within this description, be within the scope of the present disclosure, and be protected by the accompanying claims.

BRIEF DESCRIPTION OF THE DRAWINGS

Many aspects of the disclosure can be better understood with reference to the following drawings. The components in the drawings are not necessarily to scale, emphasis instead being placed upon clearly illustrating the principles of the present disclosure. Moreover, in the drawings, like reference numerals designate corresponding parts throughout the several views.

DETAILED DESCRIPTION

Figure 1:
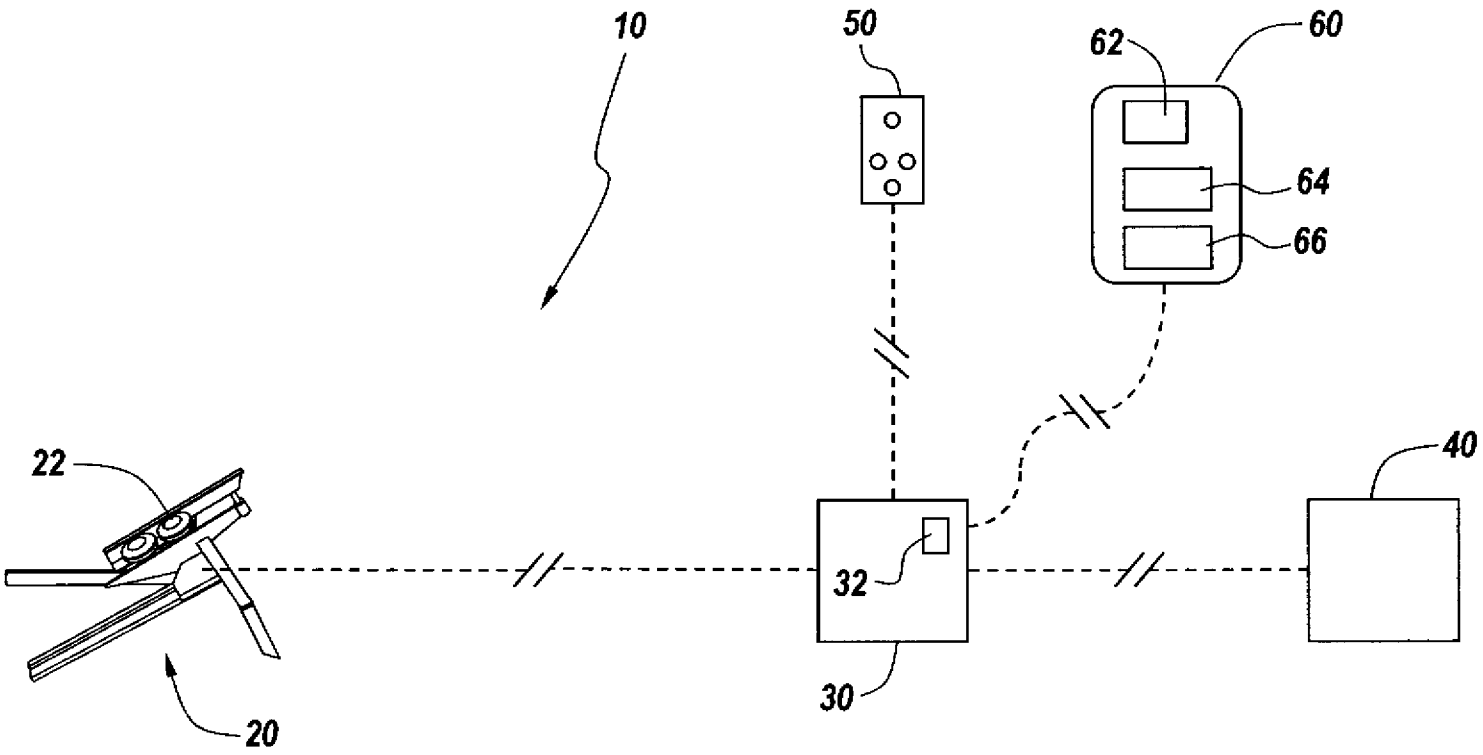
FIG. 1 is a schematic illustration of a shooting target management system, in accordance with a first exemplary embodiment of the present disclosure.

FIG. 1 is a schematic illustration of a shooting target management system 10, in accordance with a first exemplary embodiment of the present disclosure. The shooting target management system 10, which may be referred to herein as 'system 10' includes at least one target dispensing device 20 having a plurality of targets 22. A user control unit 30 is in communication with the at least one target dispensing device 20 and is positioned remotely therefrom. At least one switch 50 is in communication with the user control unit 30, wherein at least one of the plurality of targets 22 is dispensed upon activation of the switch 50. A user identification (ID) device 60 is communicable with at least the user control unit 30. The user ID device 60 stores a quantity of user ID information 64 and a quantity of user target information 66, wherein at least a portion of the quantity of user target information 66 is updated based on activation of the switch 50 by the user.

The system 10 may be used for management of the dispensing of shooting targets 22, often clay shooting targets, which may be referred to herein as clay targets, clay pigeons, traps, or skeets. The system 10 includes at least one target dispensing device 20, also called a thrower or a trap. The target dispensing device 20 may include any type of device that is capable of dispensing, launching, or throwing a shooting target. In accordance with this disclosure, dispensing a shooting target may be characterized as physically releasing a shooting target for the purpose of providing the shooting target to a firearms user, also called a shooter or a user. Any number of target dispensing devices 20 may be used with the system, and each target dispensing device 20 may hold and dispense any number of targets 22. For example, a shooting range equipped with the system 10 may have a plurality of target dispensing devices 20 that are arranged in various locations about a shooting field.

The user control unit 30 may be positioned proximate to where the user (shooter) is positioned, such that the user can easily access the user control unit 30, whereas the target dispensing device 20 is positioned remote from the user control unit 30. For example, while the target dispensing device 20 can be positioned any distance from the user control unit 30, it is commonly positioned many feet or many hundreds of feet from the user control unit 30. The user control unit 30 is in communication, either wired or wireless, with any portion of the target dispensing devices 20 used with the system 10. In one example, the user control unit 30 may control up to four (4) target dispensing devices 20, but in other examples, the user control unit 30 may control any number of target dispensing devices 20. The system 10 may include a plurality of user control units 30, such as one user control unit 30 for each shooting bay or for each active shooter.

The user control unit 30 may interface between the target dispensing device 20 and the other components of the system 10, including the switch 50 and the user ID device 60. To facilitate this interfacing, the user control unit 30 may be a computerized apparatus having a non-transitory memory, a processor, and a quantity of software or code containing instructions that can be executed by the processor. The user control unit 30 can include any other hardware or software components commonly used with computerized devices, such as input/output devices, displays, and/or communication means. For example, the user control unit 30 may include a wireless communication transceiver 32, which communicates with the user ID device 60. The user control unit 30 may also communicate via any medium, including wired or wireless communication, with the switch 50.

The switch 50 may be characterized as the remote control that the shooter uses to instruct the system 10 to dispense a target 22. The switch 50 may be positioned proximate to the user control unit 30, such as connected to the user control unit 30 with a short wire, often under 10 feet in length, or connected wirelessly to the user control unit 30. The switch 50 contains a plurality of user-selectable buttons or similar interfaces which are keyed to specific target dispensing instructions, e.g., to dispense one or more targets from one or more target dispensing devices 20. A user of the system 10 may depress one or more buttons on the switch 50, or otherwise activate the switch 50, to transmit a signal for dispensing of one or more targets 22. The switch 50 may include any number of buttons or other activation features. For example, the switch 50 may have a built-in clock to keep track of the time and/or date and the targets shot. The switch 50 may allow for voice-command launching, solo shooting, combination shooting, and shooting from multiple target dispensing devices 20. The switch 50 may employ a delay, thereby allowing the user to delay launching of the target 22 for a period of time after activation, usually around 3 seconds. Other delays may be based on any other predetermined length. Additionally, the switch may have other features that increase the usability of the system 10, such as color-coded buttons, lights, instructions, text, images, or other features.

The user ID device 60 is in communication with at least the user control unit 30, and optionally other components of the system 10. The user ID device 60 may include any type of device that can be corresponded to a user's identification, such as their name, group name, ID number, or similar identifying attributes. For example, the user ID device 60 may include a plastic card, about the size of a credit card that is paired with the user and contains user-specific information in electronic form stored on a memory of the card. The user ID device 60 may also include pluggable devices, such as dongles, keys, or other insertable components, which have a memory thereon and an interface structure that physically connects to the user control unit 30. Also, the user ID device 60 may include a portable computerized device, such as a smart phone, personal computer, or similar device that has a program or app that interfaces with the system 10. The various forms of the user ID device 60 are discussed in greater detail relative to FIGS. 3A-4C.

While the user ID device 60 may be communicable with the user control unit 30 through various systems, such as a magnetic communication system, a wired communication system, among others, the user ID device 60, in any form, may optionally include a wireless communication system 62 for communicating with the user control unit 30. For example, the user ID device 60 may contain a near-field communication (NFC) chip which wirelessly communicates with the transceiver 32 within the user control unit 30. Any type of wireless communication system 62 may be used with the user ID device 60, NFC, RFID, Bluetooth, infrared, or others. The user ID device 60 may be printed with company-specific information, such as a company name or logo.

The user ID device 60 includes the ability to store permanent and/or temporary information as well. For example, the user ID device 60 stores a quantity of user ID information 64 and a quantity of user target information 66 which can be uploaded to the user ID device 60 for temporary or permanent use. The user ID information 64 may include identifying characteristics of the user, such as their name, ID number(s), credit card or financial information, etc. The target information 66 may include information about the user's past, current, or future use of the system 10, general information about shooting at the venue, and other information relative to target shooting. The system 10 may allow for any target dispensing arrangement, including counting up (tracking an unrestricted number of targets used), counting down (tracking a predetermined number of pre-purchased or unpurchased targets), pricing arrangements based on quantity of targets 22 used, and other arrangements of target dispensing that are conventional within the industry. For example, the target information 66 may include a pre-purchased quantity of targets 22 prior to shooting the targets, the number of targets 22 dispensed after the user is finished shooting, the type of target 22, limitations or restrictions on the user's ability to dispense targets 22, or other information relative to target 22 use of the user.

As the system 10 is used to dispense targets 22 with the switch 50, at least a portion of the quantity of user target information 66 is updated. For example, if a user has pre-paid for 50 targets 22 during a shooting period, the number of targets 22 (target count) dispensed and the number of targets 22 available for dispensing may be continually updated on the user ID device 60. Accordingly, the continual updating of the target information 66 on the user ID device 60 may allow for automatic recording of the number of targets 22 used during a shooting session.

A management control unit 40 may be included with the system 10 to allow for management controls over the system 10 and/or over the user ID device 60. For example, the management control unit 40 may be located within an office or storefront that is remote from the shooting range, the user control units 30, or other components of the system 10. The management control unit 40 may be used to initially setup a user ID device 60 and/or to check out a shooter after a shooting session. Similar to the user control unit 30, the management control unit 40 may be a computerized device that functions based on software. In one example, the management control unit 40 may include software that is executed on a standard computerized device with an input device, such as a NFC device, RFID device, and/or magnetic device, that facilitates communication with the user ID device 60. The user's ID information 64 and the target information 66 may be recorded on the management control unit 40 at the initial setup of the user ID device 60. Optionally, the management control unit 40 may be in communication with the user control unit 30, other components of the system 10, networks, and/or the Internet.

In use, the system 10 may effectively and conveniently manage use of the shooting targets 22 by recording user information and target information, and by controlling the abilities and restrictions of the user. For example, when a user first arrives at a shooting range or similar venue, the user ID device 60 may be initially set up for the user. The user may be presented with the options for purchasing clay shooting targets, such as being able to pre-pay for a specific number of targets 22, shoot any number of targets 22 and pay for them after shooting is concluded, or other arrangements. The user's information, such as their name and perhaps their financial information, is input onto the user ID device 60 using the management control unit 40 to associate the user with the user ID device 60, and the selection of the user's shooting details is input onto the target information 66 of the user ID device 60. This information may be uploaded to the user ID device 60 by any number of means, including by manual input, through magnetic input, and/or through wireless communication means, such as NFC or RFID.

Once initial setup of the user ID device 60 is complete, the user can proceed to shooting at the firing range. When the user arrives at the firing range, the user places the user ID device 60 into close proximity with the user control unit 30, such as by placing the user ID device 60 into a slot or holding bay of the user control unit 30. The wireless communication system 62 built into the user ID device 60 may begin communicating with the user control unit 30. For example, the user control unit 30 may register that the user has selected to pre-purchase one-hundred (100) targets 22. When the user is ready to being shooting, the user may activate the switch 50 which transmits a signal to the user control unit 30 to instruct the target dispensing device 20 to release or launch a target 22. When the instruction to launch the target 22 is transmitted between the switch 50 and the target dispensing device 20, the user control unit 30 may modify the target information 66 on the user ID device 60 to reflect the updated use of the targets 22. Continuing with the example above, if the user activates a target dispensing device 20 to launch two (2) targets 22, the target information 66 may reflect that the user now has ninety-eight (98) remaining targets. In another example, if the user does not pre-purchase the targets, instead selecting to pay for them afterward, the target information 66 may be updated to simply count the number of targets 22 launched.

Throughout the shooting session, the user control unit 30 and the user ID device 60 may continually communicate with one another to continually update the target information 66 on the user ID device 60. The user control unit 30 may also continually display to the user specifics on target 22 usage on a display screen on the user control unit 30. The display may allow the user to see their shooting progress relative to target 22 usage at any point. If the user pre-purchased a quantity of targets 22, the user control unit 30 may inform the user when the targets 22 are all used, or the system 10 may not release any further targets 22 once the pre-purchased targets 22 are used. The user may then remove the user ID device 60 from its position proximate to the user control unit 30 and bring the user ID device 60 back to the management control unit 40. When back at the management control unit 40, the user ID device 60 may communicate the updated target information 66 to the management control unit 40. The user ID device 60 may then be closed or otherwise processed, which may include having the user pay for the shooting targets 22 used, or other actions.

The system 10 may have many other components and may offer many other functions, all of which are considered within the scope of the present disclosure. For example, the system 10 may include a maintenance mode which allows for disabling of a user control unit 30 while it is being updated or fixed. All of the components of the system 10 may be weather-proof and durable to be used for an extended period of time in inclement conditions. Further, the various components of the system 10 may be tamper and fraud proof, employing any number or type of physical and electronic security devices and systems. The management control unit 40 may allow for overall tracking of target 22 usage at a particular venue, including the ability to keep track of target usage by day, month, year, or any other period, and the ability to track target usage by user. Any information within the system 10, especially the user ID information 64, may be recorded within databases in the system 10 and used for communicating with the users, such as with mass marketing, e-mails, and letters.

Figure 2:
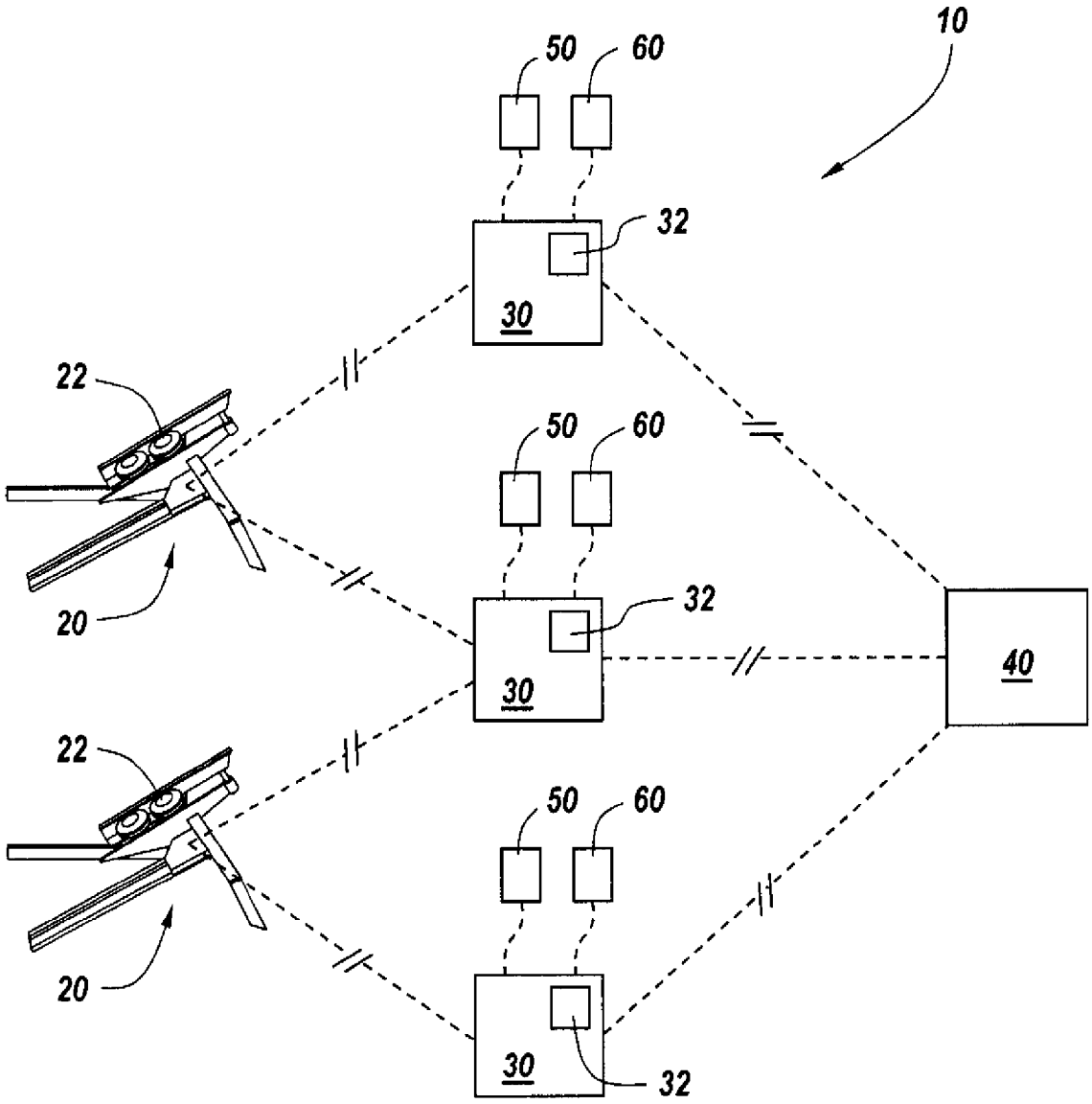
FIG. 2 is a schematic illustration of the shooting target management system, in accordance with the first exemplary embodiment of the present disclosure.

FIG. 2 is a schematic illustration of the shooting target management system 10, in accordance with the first exemplary embodiment of the present disclosure. The system 10 shown in FIG. 2 depicts the system 10 having a plurality of user control units 30, a plurality of switches 50 for each of the user control units 30, and a plurality of user ID cards 60. The user control units 30 may be in communication with any number of target dispensing devices 20 to dispense the targets 22. As can be seen, one management control unit 40 may be in communication with each of the user control units 30. The components and the functionality of the system 10 may be the same as is described relative to FIG. 1.

Figure 3A:
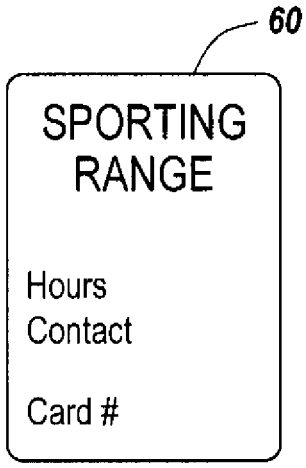
FIG. 3A is a schematic illustration of the user ID device of FIGS. 1-2 being a user ID card, in accordance with the first exemplary embodiment of the present disclosure.

FIG. 3A is a schematic illustration of the user ID device 60 of FIGS. 1-2 being a user ID card, in accordance with the first exemplary embodiment of the present disclosure. In this example, the user ID device 60 may include a plastic card, about the size of a credit card that is paired with the user and contains user-specific information in electronic form stored on a memory of the card. The card may have a magnetic strip, an embedded wireless communication system, such as a NFC chip, or another communication system. The card may also have a card ID number and other short-term or long-term identifying information of either the entity supplying the card to the user or the user itself.

Figure 3B:
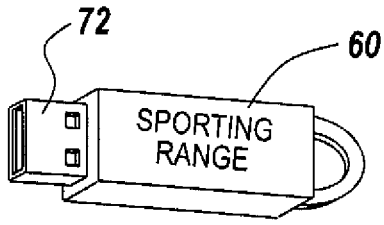
FIG. 3B is a schematic illustration of the user ID device of FIGS. 1-2 being a user ID dongle, in accordance with the first exemplary embodiment of the present disclosure.

FIG. 3B is a schematic illustration of the user ID device 60 of FIGS. 1-2 being a user ID dongle, in accordance with the first exemplary embodiment of the present disclosure. In this example, the user ID device 60 is a pluggable device, such as a dongle, a key, or another insertable component that can be received by the user control unit 30 (FIGS. 1-2). The dongle may include a memory which houses all of the information stored on the user ID device 60, as discussed relative to FIG. 1. The dongle may further include an interfacing structure 72, such as a male-to-female connector, which is engagable with a compatible connector on the user control unit 30. Thus, the interfacing structure may allow the dongle to physically connect to the user control unit 30.

Figure 3C:
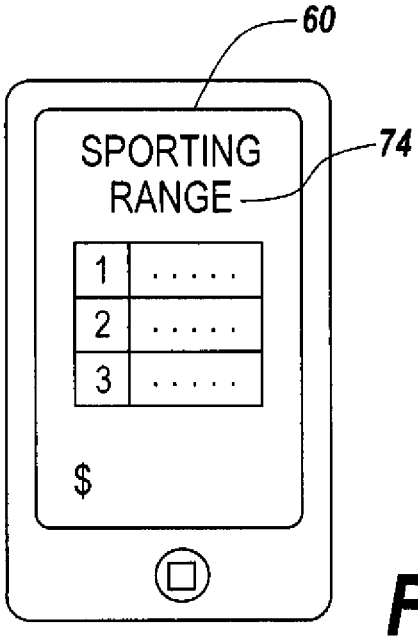
FIG. 3C is a schematic illustration of the user ID device of FIGS. 1-2 being a smart telephone having a user ID program, in accordance with the first exemplary embodiment of the present disclosure.

FIG. 3C is a schematic illustration of the user ID device 60 of FIGS. 1-2 being a smart telephone having a user ID program, in accordance with the first exemplary embodiment of the present disclosure. In this example, the user ID device 60 is a portable computerized device, such as a smart phone, personal computer, or similar device that has a program or app 74 (shown on the GUI of the smart phone) that interfaces with the system 10. For instance, the portable computerized device may include a smart phone which has a memory, a processor, and at least one wireless communication system thereon (often, may include many wireless communication systems). The smart phone may include a plurality of computerized programs executed by the processor, often referred to as an 'app'. The computerized program may have quantities of code for controlling use of the smart phone as a user ID device 60. The quantity of user ID information and the quantity of user target information may be communicated to the user control unit 30 using the at least one wireless communication system of the smart phone.

It is noted that the user ID device 60 as a smart phone may allow for significant convenience with the system 10, since it may facilitate various other aspects of the system that would otherwise be done at the management control unit 40 (FIGS. 1-2). For example, the smart phone may include a payment interface, wherein a quantity of targets is purchased through the payment interface by the user. Common examples of payment interfaces include PayPal®, credit card portals, or banking portals, all of which may allow the user to purchase targets prior to using the system 10, during use of the system 10, or to pay for used targets after using the system 10. In one example, the smart phone may have a NFC chip which allows it to directly connect to the user control unit 30.

Figure 4A:
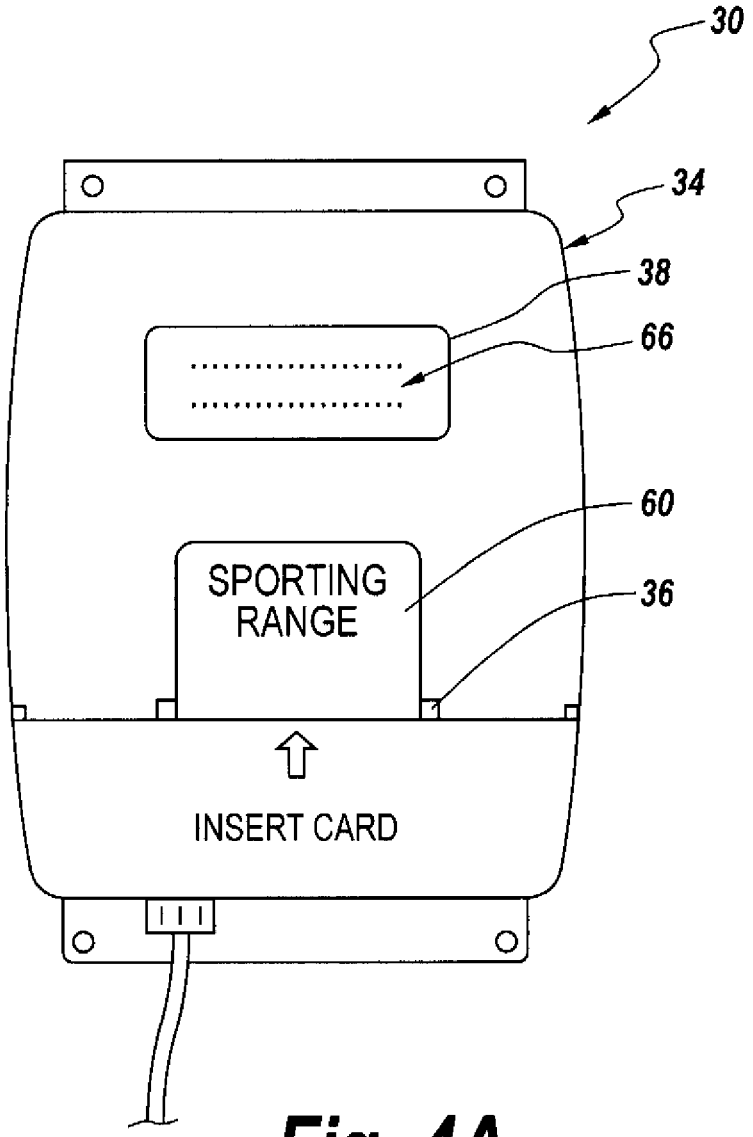
FIG. 4A is a front view of a user control unit of the shooting target management system of FIG. 1 capable of receiving the user ID card of FIG. 3A, in accordance with the first exemplary embodiment of the present disclosure.

FIG. 4A is a front view of a user control unit 30 of the shooting target management system 10 of FIG. 1 capable of receiving the user ID card of FIG. 3A, in accordance with the first exemplary embodiment of the present disclosure. As can be seen, the user control unit 30 may include a housing 34 which includes a slot 36 for holding the user ID device 60 as a card. The user control unit 30 may include a display screen 38 which displays target information 66 from the user ID device 60, or information relative to the targets independent of the user ID device 60. The slot 36 may be adapted to hold the user ID device 60 close enough for a NFC system to function between the user control unit 30 and the user ID device 60.

Figure 4B:
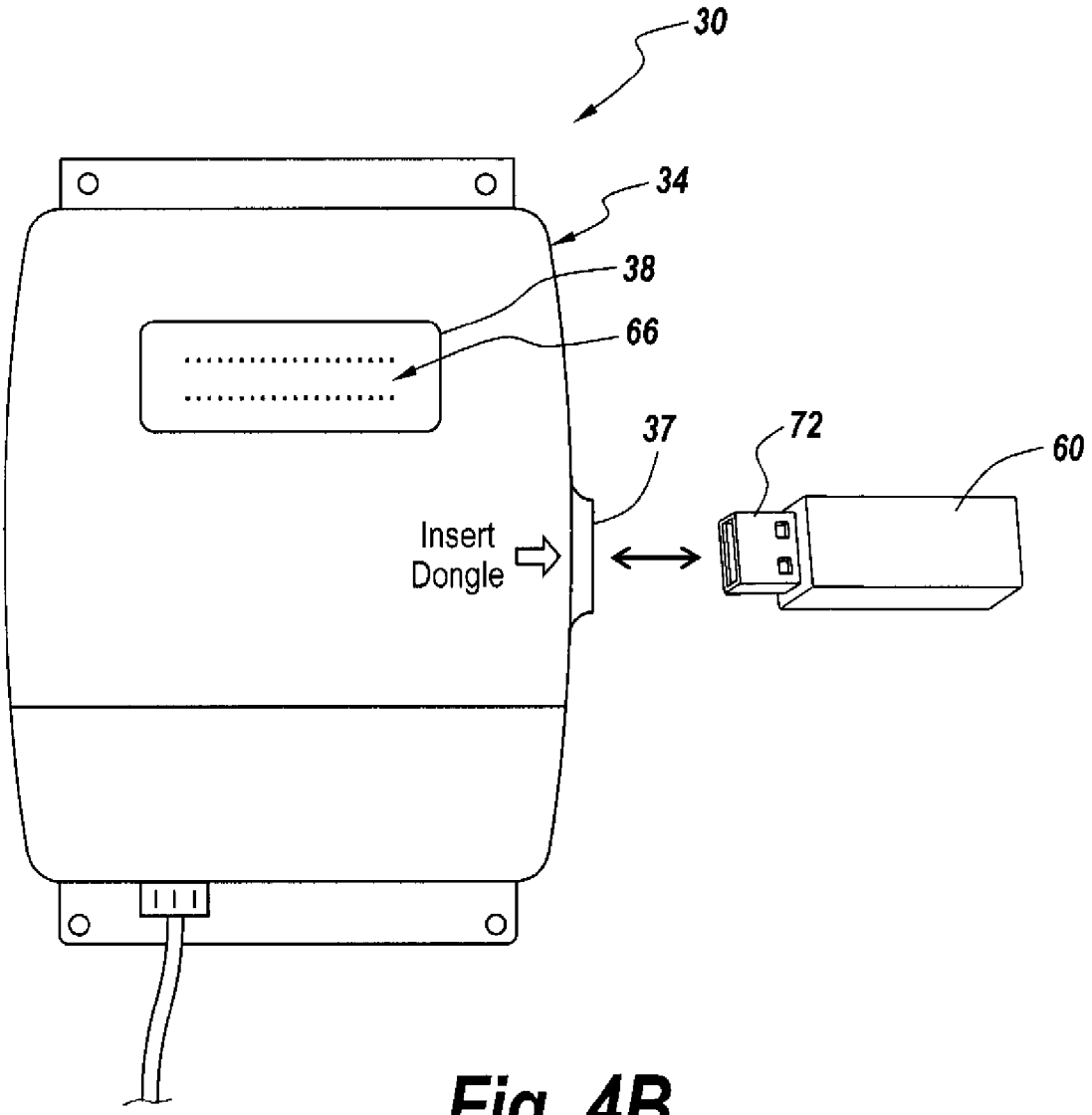
FIG. 4B is a front view of a user control unit of the shooting target management system of FIG. 1 capable of receiving the user ID dongle of FIG. 3B, in accordance with the first exemplary embodiment of the present disclosure.

FIG. 4B is a front view of a user control unit of the shooting target management system of FIG. 1 capable of receiving the user ID dongle of FIG. 3B, in accordance with the first exemplary embodiment of the present disclosure. Here, the user control unit 30 may include a housing 34 which includes an interface port 37 for engaging with the user ID device 60 as a dongle, which has a corresponding interface structure 72. The user control unit 30 may include a display screen 38 which displays target information 66 from the user ID device 60, or information relative to the targets independent of the user ID device 60. The interface port 37 may be physically and electronically engage with the user ID device 60 to facilitate communication between the user control unit 30 and the user ID device 60.

Figure 4C:
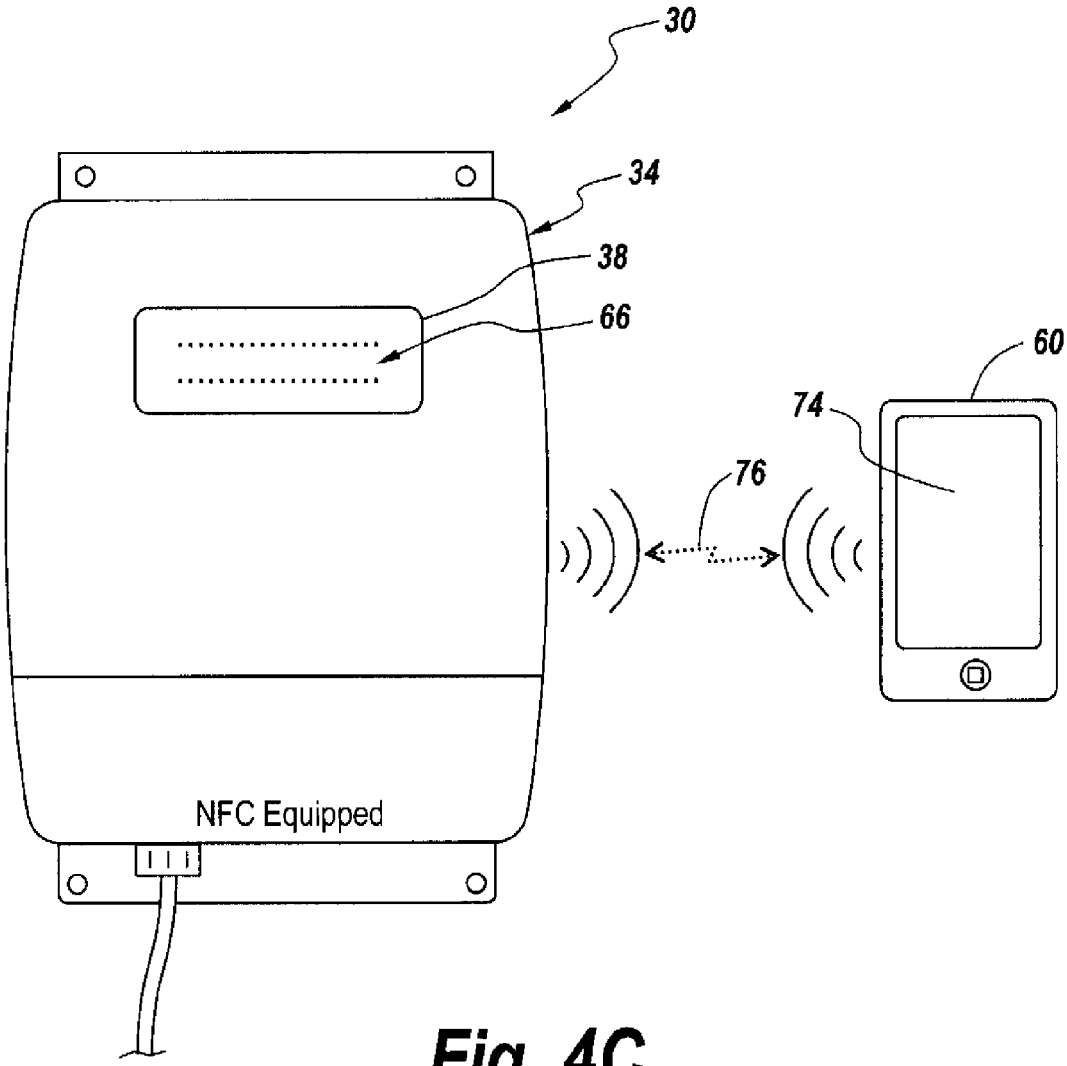
FIG. 4C is a front view of a user control unit of the shooting target management system of FIG. 1 capable of communicating with the smart telephone with the user ID program of FIG. 3C, in accordance with the first exemplary embodiment of the present disclosure.

FIG. 4C is a front view of a user control unit of the shooting target management system of FIG. 1 capable of communicating with the smart telephone with the user ID program of FIG. 3C, in accordance with the first exemplary embodiment of the present disclosure. In this example, the user control unit 30 may include a housing 34 which includes a wireless system for transmitting and/or receiving a wireless signal 76 to or from the smart phone being the user ID device 60. Specifically, the wireless signal 76 may communicate the instructions and/or information from the app 74 on the smart phone. The user control unit 30 may include a display screen 38 which displays target information 66 from the user ID device 60, or information relative to the targets independent of the user ID device 60. The wireless communication system may be capable of electronically engaging with the user ID device 60 when it is located within a range, thereby facilitating communication between the user control unit 30 and the user ID device 60.

Figure 5:
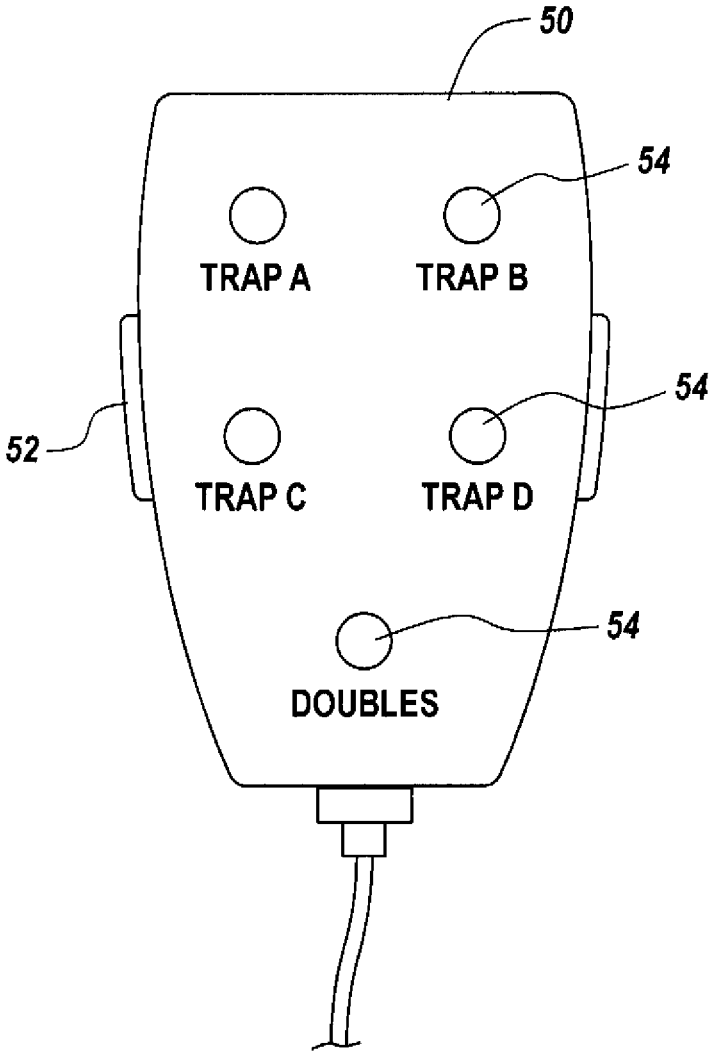
FIG. 5 is a front view of a switch of the shooting target management system of FIG. 1, in accordance with the first exemplary embodiment of the present disclosure.

FIG. 5 is a front view of a switch 50 of the shooting target management system 10 of FIG. 1, in accordance with the first exemplary embodiment of the present disclosure. As can be seen in FIG. 5, the switch 50 may be a device that is easily used by the user or another person to activate launching of a target. The switch 50 may include a plurality of user-selectable inputs 54, such as buttons or other input features, each one of which is keyed to a specific aspect of the system. For example, a first user-selectable input 54 may be keyed to trap A, whereas a second user-selectable input 54 may be keyed to trap B, and so forth. Other user-selectable inputs 54 may be keyed to a multiple target selector input, such as an input that instructs double traps to be dispensed. The switch 50 may be secured proximate to the user with a holder 52, which allows for convenient selection of the user-selectable input 54. The switch 50 may also include a foot pedal which the user activates with his or her foot. The user-selectable inputs 54 may also be keyed to various target launching schemes, such as pre-programmed launching routines which are composed of various traps and various quantities of targets. All configurations of the user-selectable inputs on the switch 50 are considered within the scope of the present disclosure.

With relevance to FIGS. 1-5 herein, it is noted that the system 10 may include various other components, features, and capabilities including a voice-operated digital transmitter paired with the switch 50 or used in replacement of the switch 50, thereby allowing voice command control of dispensing of the targets. The voice circuitry may be built into the user control unit and may provide for launching of targets in singles, true pairs and report pairs. A microphone may be removably included with the unit. The unit may include a "lock on" feature which may enable the user to choose various traps, doubles, or for continual voice calling of the target. Accordingly, the voice-activated system unit may eliminate the need to keep pressing buttons on the switch 50.

Figure 6:
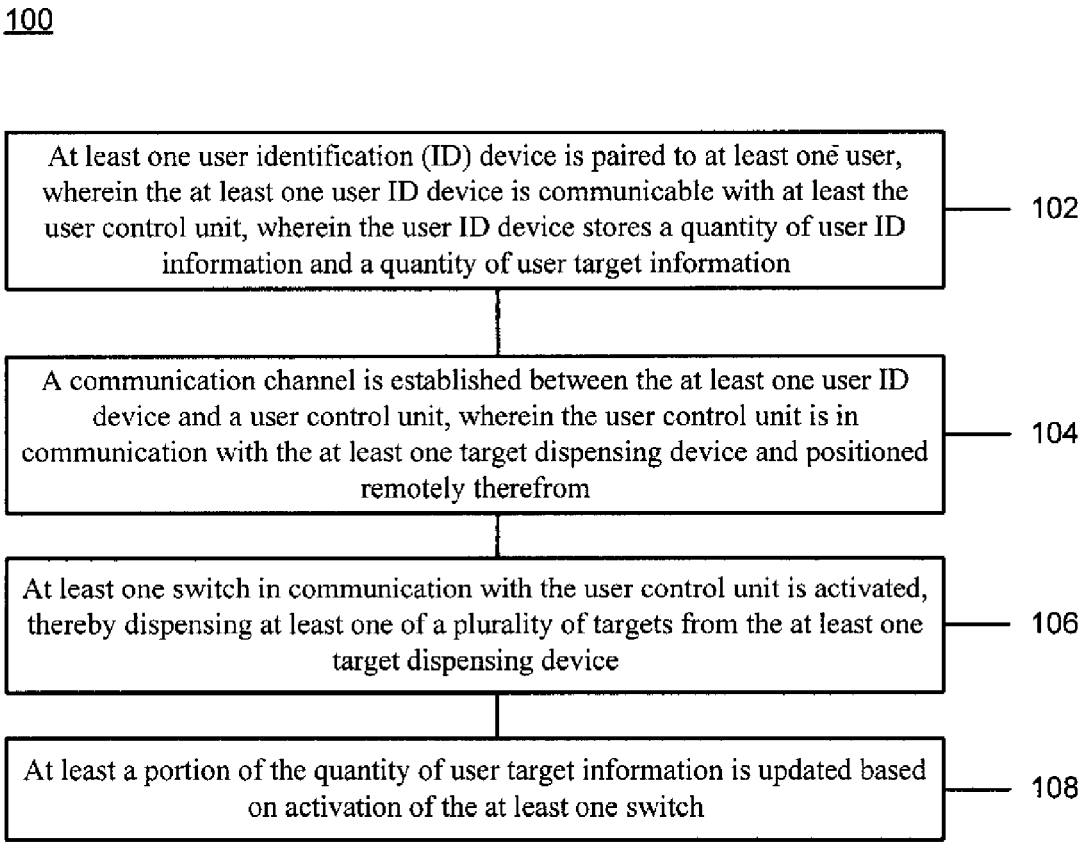
FIG. 6 is a flowchart illustrating a method of using a shooting target management system, in accordance with a second exemplary embodiment of the disclosure.

FIG. 6 is a flowchart 100 illustrating a method of using a shooting target management system, in accordance with a second exemplary embodiment of the disclosure. It should be noted that any process descriptions or blocks in flow charts should be understood as representing modules, segments, portions of code, or steps that include one or more instructions for implementing specific logical functions in the process, and alternate implementations are included within the scope of the present disclosure in which functions may be executed out of order from that shown or discussed, including substantially concurrently or in reverse order, depending on the functionality involved, as would be understood by those reasonably skilled in the art of the present disclosure.

As is shown by block 102, at least one user identification (ID) device is paired to at least one user, wherein the at least one user ID device is communicable with at least the user control unit, wherein the user ID device stores a quantity of user ID information and a quantity of user target information. A communication channel is established between the at least one user ID device and a user control unit, wherein the user control unit is in communication with the at least one target dispensing device and positioned remotely therefrom (block 104). At least one switch in communication with the user control unit is activated, thereby dispensing at least one of a plurality of targets from the at least one target dispensing device (block 106). At least a portion of the quantity of user target information is updated based on activation of the at least one switch (block 108).

The method may include any additional number of steps, processes, functions, or components, including any disclosed within this disclosure. For example, the step of activating the at least one switch in communication with the user control unit, thereby dispensing at least one of the plurality of targets from the at least one target dispensing device may further include activating at least one user-selectable input on the at least one switch, the at least one user-selectable input corresponding to at least one of a target dispensing location and a target quantity, and delaying dispensing of the at least one of the plurality of targets a predetermined period of time after activating the at least one user-selectable input.

The user ID device further comprises a smart telephone having a memory, a processor, and at least one wireless communication system, wherein establishing the communication channel between the at least one user ID device and the user control unit further comprises executing a computerized program stored on the memory with the processor, thereby communicating the quantity of user ID information and the quantity of user target information to the user control unit using the at least one wireless communication system. Updating the quantity of user target information based on activation of the at least one switch may include updating a remaining target count based on a total quantity of purchased targets and a number of activations of the switch and/or updating a used target count based on a number of activations of the switch.

A management control device may provide administrative management control of the user control unit, wherein the at least one management control device is selectably communicable with the user ID device through at least one of: a magnetic communication system, a wired communication system, and a wireless communication system. The quantity of user ID information and the quantity of user target information on the user ID device may be controlled based on an input from the management control device communicated through the at least one of: the magnetic communication system, the wired communication system, and the wireless communication system.

It should be emphasized that the above-described embodiments of the present disclosure, particularly, any "preferred" embodiments, are merely possible examples of implementations, merely set forth for a clear understanding of the principles of the disclosure. Many variations and modifications may be made to the above-described embodiments of the disclosure without departing substantially from the spirit and principles of the disclosure. All such modifications and variations are intended to be included herein within the scope of this disclosure and the present disclosure and protected by the following claims.

What is claimed is:

1. A shooting target management system comprising:

at least one target dispensing device having a plurality of targets;

a user control unit in communication with the at least one target dispensing device and positioned remotely therefrom;

at least one switch in communication with the user control unit, wherein at least one of the plurality of targets is dispensed from the at least one target dispensing device upon activation of the switch; and a user identification (ID) device communicable with the user control unit, the user ID device storing a quantity of user ID information and a quantity of user target information, wherein at least a portion of the quantity of user target information is updated based on activation of the switch by the user.

2. The shooting target management system of claim 1, wherein the user ID device has a wireless communication system for wireless communication with at least the user control unit.

3. The shooting target management system of claim 1, wherein the user ID device further comprises a user ID card.

4. The shooting target management system of claim 1, wherein the user ID device further comprises a user ID dongle having an interface structure.

5. The shooting target management system of claim 1, wherein the user ID device further comprises a portable computerized device.

6. The shooting target management system of claim 5, wherein the portable computerized device further comprises a smart telephone, wherein the smart telephone further comprises:

a memory, a processor, and at least one wireless communication system; and a computerized program executed by the processor, wherein the computerized program communicates the quantity of user ID information and the quantity of user target information to the user control unit using the at least one wireless communication system.

7. The shooting target management system of claim 6, wherein the computerized program further comprises a payment interface, wherein a quantity of targets is purchased through the payment interface by the user.

8. The shooting target management system of claim 6, wherein the wireless communication system further comprises a near-field communication (NFC) chip.

9. The shooting target management system of claim 1, further comprising a management control device communicable with the user ID device, wherein at least one of the quantity of user ID information and the quantity of user target information on the user ID device is controlled based on an input from the management control device.

10. The shooting target management system of claim 9, wherein the management control device is communicable with the user ID device through at least one of: a magnetic communication system, a wired communication system, and a wireless communication system.

11. The shooting target management system of claim 1, wherein the at least the portion of the quantity of user target information updated based on activation of the switch by the user further comprises updating a remaining target count based on a total quantity of purchased targets and a number of activations of the switch.

12. The shooting target management system of claim 1, wherein the at least the portion of the quantity of user target information updated based on activation of the switch by the user further comprises updating a used target count based on a number of activations of the switch.

13. The shooting target management system of claim 1, wherein the at least one switch further comprises a plurality of user-selectable inputs, wherein the plurality of user-selectable inputs further comprises at least one of:

a first trap input;

a second trap input, wherein the second trap is distinct from the first trap; and a multiple target selector input.

14. A method of managing shooting target usage, the method comprising the steps of:

pairing at least one user identification (ID) device to at least one user, wherein the at least one user ID device is communicable with at least the user control unit, wherein the user ID device stores a quantity of user ID information and a quantity of user target information;

establishing a communication channel between the at least one user ID device and a user control unit, wherein the user control unit is in communication with the at least one target dispensing device and is positioned remotely therefrom;

activating at least one switch in communication with the user control unit, thereby dispensing at least one of a plurality of targets from the at least one target dispensing device; and updating at least a portion of the quantity of user target information based on activation of the at least one switch.

15. The method of claim 14, wherein the step of activating the at least one switch in communication with the user control unit, thereby dispensing at least one of the plurality of targets from the at least one target dispensing device further comprises the steps of:

activating at least one user-selectable input on the at least one switch, the at least one user-selectable input corresponding to at least one of a target dispensing location and a target quantity; and delaying dispensing of the at least one of the plurality of targets a predetermined period of time after activating the at least one user-selectable input.

16. The method of claim 14, wherein the at least one user ID device further comprises a smart telephone having a memory, a processor, and at least one wireless communication system, wherein establishing the communication channel between the at least one user ID device and the user control unit further comprises executing a computerized program stored on the memory with the processor, thereby communicating the quantity of user ID information and the quantity of user target information to the user control unit using the at least one wireless communication system.

17. The method of claim 14, wherein the step of updating the portion of the quantity of user target information based on activation of the at least one switch further comprises updating a remaining target count based on a total quantity of purchased targets and a number of activations of the switch.

18. The method of claim 14, wherein the step of updating the portion of the quantity of user target information based on activation of the at least one switch further comprises updating a used target count based on a number of activations of the switch.

19. The method of claim 14, further comprising the step of providing administrative management control of the user control unit with at least one management control device, wherein the at least one management control device is selectably communicable with the user ID device through at least one of: a magnetic communication system, a wired communication system, and a wireless communication system.

20. The method of claim 19, wherein at least one of the quantity of user ID information and the quantity of user target information on the user ID device is controlled based on an input from the management control device communicated through the at least one of: the magnetic communication system, the wired communication system, and the wireless communication system.

* * * * *